US007699900B2

(12) United States Patent
Ruiz

(10) Patent No.: US 7,699,900 B2
(45) Date of Patent: Apr. 20, 2010

(54) FUEL ADDITIVE

(75) Inventor: Diego A. Ruiz, Sag Harbor, NY (US)

(73) Assignee: Simple Energy Solutions, Inc., Sag Harbor, NY (US)

( * ) Notice: Subject to any disclaimer, the term of this patent is extended or adjusted under 35 U.S.C. 154(b) by 428 days.

(21) Appl. No.: 11/861,334

(22) Filed: Sep. 26, 2007

(65) Prior Publication Data

US 2009/0077870 A1 Mar. 26, 2009

(51) Int. Cl.
*C10L 1/185* (2006.01)
*C10L 1/18* (2006.01)
*C10L 1/19* (2006.01)

(52) U.S. Cl. ..... 44/401; 44/437; 44/439

(58) Field of Classification Search ..... 44/388, 44/439, 401, 402; 508/459, 463, 577
See application file for complete search history.

(56) References Cited

U.S. PATENT DOCUMENTS 3,658,708 A * 4/1972 Ratto ..... 508/489
3,976,438 A 8/1976 Bay
4,294,586 A 10/1981 Cox, Jr.
4,376,636 A 3/1983 Weinberger
4,482,352 A 11/1984 Osgood et al.
4,609,379 A 9/1986 Kitchen
5,264,005 A * 11/1993 Blythe ..... 44/388
5,488,191 A 1/1996 Chu et al.
5,766,272 A 6/1998 Lozzi
6,123,742 A 9/2000 Smith
6,187,299 B1 * 2/2001 Wimmer et al. ..... 424/61
6,348,074 B2 2/2002 Wenzel
6,353,143 B1 3/2002 Fang et al.
6,454,818 B1 9/2002 Lin et al.
6,627,775 B2 9/2003 Lin et al.
6,743,266 B2 6/2004 DeRosa et al.
6,858,047 B1 2/2005 Norman
6,923,838 B2 8/2005 Maubert et al.
7,195,654 B2 3/2007 Jackson et al.
2001/0005957 A1 7/2001 Haji et al.
2004/0060225 A1 4/2004 Krull et al.
2004/0065002 A1 4/2004 Hu
2004/0154218 A1 8/2004 Watanabe et al.
2005/0155280 A1 7/2005 Schwahn et al.
2006/0201056 A1 9/2006 Jordan
2007/0028508 A1 2/2007 Bruno

* cited by examiner

*Primary Examiner*—Cephia D Toomer
*Assistant Examiner*—Pamela Weiss
(74) *Attorney, Agent, or Firm*—Tutunjian & Bitetto, P.C.

(57) ABSTRACT

A fuel additive that provides increased fuel efficiency, while at the same time reduces harmful emissions from combustion engines. The fuel additive is a combination of a synthetic oil blend, ethyl acetate and acetone. In one particular implementation, the amount of acetone is equal to at least 10% of an overall volume of the additive.

4 Claims, No Drawings

FUEL ADDITIVE

BACKGROUND

1. Technical Field

The present principles relate to fuel for combustion engines. More particularly, it relates to a fuel additive for increasing efficiency of combustion engines.

2. Description of Related Art

Ongoing efforts have been made over the years to control the emissions created by the use of hydrocarbon fuels and to increase the performance of such fuels. One method that has been used is to increase the oxygen content of the fuels, for example by adding ethanol, as is done in the Midwest region of the United States, or by adding methyl tertiary butyl ether (MTBE), as is required in California and in major U.S. cities. However, MTBE is quite water soluble and the ground water in many parts of the United States is contaminated by MTBE. However, MTBE itself is a pollutant since it is very water-soluble and any fuel leak will pollute ground water with MTBE. Other proposed methods of increasing the oxygen content of fuels include adding ethers alone or adding ethers mixed with alcohols. Alcohols have the disadvantage that fuels that contain alcohols can become acidic from air oxidation of the alcohol and can form solids hat will plug filters and injectors if the fuel is stored for a long period of time. Further, alcohol compounds impart no lubricity to the fuel and can make the fuel more corrosive.

Peroxides have also been proposed as a source of oxygen for fuels, but peroxides are unstable and can cause the chemical breakdown of fuel in storage tanks, which makes the fuel unusable.

At the present time, there is a need for a product that has both a capability of effectively controlling harmful emissions in fuels such as middle distillate fuels and gasoline and a chemical compatibility with such fuels, so that the fuels remain stable for long periods of time under typical storage conditions.

The combustion performance in a combustion chamber of automobile and an oil burning boiler is one of important performance indexes, and it determines whether a fuel oil has properties of energy-saving, environment protection, and the like. For a gasoline product, an important performance index is the antiknock property, and its antiknock index is generally expressed as the average value of an octane number determined by research method (RON) and an octane number determined by motor method (MON). In order to produce a high-octane number gasoline, one method is the improvement of petroleum refining technology by means of catalytic cracking, alkylation, platinum reforming, or the like, but the technological improvement is limited by a variety of factors, including reform and renovation of equipments, funds, a complete set of techniques, and so on; and another method is the addition of a suitable antiknock agent into gasoline.

The energy saving and the reduction of pollution of automobile tail gas exhausted to the environment have become worldwide problems, and they can be realized by three operations: improvement of the refining technology of petroleum, improvement of engine or combustion equipments (e.g., oil burning boiler) and addition of a suitable additive. Components of energy-saving and decontaminating additives for diesel oil, kerosene, heavy oil, resid are roughly divided into two kinds: one kind is peroxides and another kind is oil-soluble substances containing heavy metals. It has been found in uses that the former is unfavorable to the storage of oils, and the latter results in abrasion of engine and causes new environmental pollution.

Antifriction and anticorrosion effects on engine at work given by adding a mixture (not a synthetic) of a tricarboxylic amide or tetracarboxylic amide and an alkali metal or alkali-earth metal salt into a fuel oil have been disclosed in U.S. Pat. No. 4,871,375. However, the content of nitrides in the exhaust gas of automobile is increased by the use of amine compounds because of the addition of nitrogen atom. Moreover, effects of this additive on increasing the antiknock property of gasoline, saving energy of oils such as gasoline, diesel oil, kerosene, resid, and the like and reducing the contamination of exhaust gas have not been described in the literature.

A diesel oil additive has been disclosed in U.S. Pat. No. 5,593,464, and it is a synthetic product of a distilled resid and an alkali metal, alkali-earth metal or rare-earth metal and can inhibit carbon deposit and smoke dust, but whether the additive has an energy-saving effect and an antifriction effect on engine and also whether the additive is applicable to fuel oils other then diesel oil have not been described.

Problems common to these antiknock agents are low effectiveness, large amount, and diseconomy and inconvenience. The other kind of gasoline antiknock agent is organometallic compounds, and they have high effectiveness and small amount. Tetraethyl lead used for many years has been prohibited because of the toxicity of lead. Ferrocene (dicyclopentadienyl iron) and cyclopentadienylmanganese tricarbonyl (wrong word "tricarboxyl" in the original specification, translator) have been proposed as antiknock agent in U.S. Pat. No. 4,139,349; methylcyclopentadienylmanganese tricarbonyl (wrong word "tricarboxyl" in the original specification, translator) have been proposed as antiknock agent in U.S. Pat. No. 4,437,436 and is produced in Ethyl Co., USA now; and complexes of cerium and .A-inverted., -diones have been proposed as antiknock agent in U.S. Pat. No. 4,211,535. Among these compounds, ferrocene has been prohibited because of a harmful effect on engine, the manganese-base antiknock agents have been limited and prohibited because of its poisonous effect on human nerves and environment, and complexes of cerium and .A-inverted., -diones have a too high cost to popularize.

The combustion of fuel in an internal combustion engine typically results in the formation and accumulation of deposits on various parts of the combustion chamber and on the fuel intake and exhaust systems of the engine. The presence of these deposits in the combustion chamber often result inn the following problems: (1) reduction in the operating efficiency of the engine; (2) inhibition in the heat transfer between the combustion chamber and the engine cooling system; and (3) reduction in the volume of the combustion zone which can cause a higher than design compression ratio in the engine. A knocking engine can also result from deposits forming and accumulating in the combustion chamber.

A prolonged period of a knocking engine can result in stress fatigue and wear in engine components such as, for example, pistons, connecting rods bearings and cam rods. The rate of wear tends to increase under harsh temperature and pressure conditions which exist inside the engine. In addition to limiting the useful life of the components in the engine being used, wear of the components can be costly because the engine components themselves are expensive to produce. Other significant problems associated with wear include, for example, down time for equipment, reduced safety and diminished reliability.

One approach to achieving enhanced fuel economy and thereby reducing the wear of engine components is by improving the efficiency of the internal combustion engine in which the fuel is used. Improvement in the engine's efficiency can be achieved through a number of methods, e.g., (1) improving control over fuel/air ratio; (2) decreasing the crankcase oil viscosity; and, (3) reducing the internal friction of the engine in certain specific areas due to wear. In method (3), for example, inside an engine, about 18 percent of the fuel's heat value, i.e., the amount of heat released in the combustion of the fuel and therefore able to perform work, is dissipated due to internal friction at engine components, e.g., bearings, valve train, pistons, rings, water and oil pumps, etc. Only about 25 percent of the fuel's heat value is converted to useful work at the crankshaft. Friction occurring at the piston rings and parts of the valve train account for over 50 percent of the heat value loss. A lubricity improving fuel additive capable of reducing friction at these engine components by a third preserves an additional three percent of the fuel's heat value for useful work at the crankshaft. Therefore, there has been a continual search for fuel additives which improve the delivery of friction modifier to strategic areas of the engine thereby improving the fuel economy of engines.

For example, U.S. Pat. Nos. 2,252,889, 4,185,594, 4,208,190, 4,204,481 and 4,428,182 disclose anti-wear additives for fuels adapted for use in diesel engines consisting of fatty acid esters, unsaturated dimerized fatty acids, primary aliphatic amines, fatty acid amides of diethanolamine and long-chain aliphatic monocarboxylic acids.

U.S. Pat. No. 4,427,562 discloses a friction reducing additive for lubricants and fuels formed by the reaction of primary alkoxyalkylamines with carboxylic acids or alternatively by the ammonolysis of the appropriate formate ester.

U.S. Pat. No. 4,729,769 discloses a detergent additive for gasoline, which contains the reaction product of a C.sub.6-C.sub.20 fatty acid ester such as coconut oil and a mono- or di-hydroxy hydrocarbyl amine such as diethanolamine or dimethylaminopropylamine.

SUMMARY

According to an aspect of the present principles, the fuel additive includes a synthetic oil blend, ethyl acetate, and acetone. The acetone is provided in an amount equal to at least 10% of an overall volume of the fuel additive. The synthetic oil blend generally makes up 30% of the overall volume of the fuel additive, while the ethyl acetate makes up the remaining 60% of the overall volume.

According to another implementation of the present principles, the method for manufacturing a fuel additive includes the steps of, measuring out a synthetic oil blend in an amount of 30% by volume at room temperature, adding ethyl acetate in an amount of 60% by volume, adding acetone in an amount of 10% by volume, blending the fuel additive until a predetermine consistency has been reached, and continuing the blending during the bottling process.

The blending can be performed using pump or agitation blending techniques.

Other aspects and features of the present principles will become apparent from the following detailed description considered in conjunction with the accompanying drawings. It is to be understood, however, that the drawings are designed solely for purposes of illustration and not as a definition of the limits of the present principles, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION

In accordance with one implementation of the present principles, the primary ingredients for the fuel additive are: 1) a synthetic oil blend; 2) ethyl acetate; and 3) acetone. The combination of these ingredients and the amounts of the same are integral in achieving increase fuel efficiency and reduced emissions. The preferred percentages of the respective ingredients are: 1) 30% synthetic oil blend; 2) 60% ethyl acetate; and 3) 10% Acetone. An example of the synthetic oil blend could be a 2 cycle engine fuel premix.

When manufacturing the fuel additive of the present principles, the mixing process is important to prevent separation of the respective ingredients. Initially, and at room temperature, the synthetic oil blend is measured, and the ethyl acetate and acetone are added in sequence. The ingredients are blended by a pump or agitation until a predetermined consistency is reached. In order to reach the proper consistency, the blending must be performed for a minimum of 15 minutes.

Another important aspect of the process is that the blending must continue throughout the bottling process so as to prevent undesirable separation of the ingredients.

The mixing of the ingredients as listed above are performed in the specific order for two reasons: 1) the oil product is less volatile. Therefore the addition of the flammables to the oil reduces the risks associated with mixing of flammables; and 2) the oil product has a higher viscosity (i.e., is thicker). The ethyl acetate clears the lines of the missing apparatus of the oil product, therefore assuring a more consistent mix.

While there have been shown, described and pointed out fundamental novel features of the present principles, it will be understood that various omissions, substitutions and changes in the form and details of the methods described and devices illustrated, and in their operation, may be made by those skilled in the art without departing from the spirit of the same. For example, it is expressly intended that all combinations of those elements and/or method steps which perform substantially the same function in substantially the same way to achieve the same results are within the scope of the present principles. Moreover, it should be recognized that structures and/or elements and/or method steps shown and/or described in connection with any disclosed form or implementation of the present principles may be incorporated in any other disclosed, described or suggested form or implementation as a general matter of design choice. It is the intention, therefore, to be limited only as indicated by the scope of the claims appended hereto.

What is claimed is:

1. A fuel additive comprising:

30% by volume a synthetic oil blend;

60% by volume ethyl acetate; and acetone, wherein said acetone is provided in an amount equal to at least 10% of an overall volume of the fuel additive.

2. A method for manufacturing a fuel additive comprising the steps of:

measuring out a synthetic oil blend in an amount of 30% by volume at room temperature;

adding ethyl acetate in an amount of 60% by volume;

adding acetone in an amount of 10% by volume;

blending the fuel additive until a predetermine consistency has been reached; and continuing the blending during the bottling process.

3. The method of claim 2, wherein said blending is performed using pump blending techniques.

4. The method of claim 2, wherein said blending is performed using agitation blending techniques.

* * * * *